United States Patent [19]

Hay, deceased

[11] 4,225,993

[45] Oct. 7, 1980

[54] CIRCULAR LIFEBOAT

[76] Inventor: Donald A. Hay, deceased, late of Bethesda, Md., by Robert D. Hay, personal representative

[21] Appl. No.: 911,428

[22] Filed: Jun. 1, 1978

[51] Int. Cl.[2] ..... B63C 9/02

[52] U.S. Cl. ..... 9/4 R; 9/1.3; 9/1.5

[58] Field of Search ..... 9/1.3, 1.5, 3, 4 R, 9/4 A, 11 R; 296/78 R, 84 R, 84 A, 84 N, 89; 160/368 S

[56] References Cited

U.S. PATENT DOCUMENTS

| | | | |
|---|---|---|---|
| 1,360,755 | 11/1920 | Jordan | 9/4 R |
| 1,631,046 | 5/1927 | McCullough | 296/84 R |
| 2,619,376 | 11/1952 | Matheny et al. | 296/84 R |
| 2,836,457 | 5/1958 | Beerman et al. | 296/84 R X |
| 2,974,329 | 3/1961 | Welch | 296/78 R X |
| 3,123,843 | 3/1964 | Tangen | 9/11 R |
| 3,259,926 | 7/1966 | Otterman | 9/4 R |
| 3,896,515 | 7/1975 | Otterman | 9/4 R |

FOREIGN PATENT DOCUMENTS

| | | | |
|---|---|---|---|
| 475386 | 5/1914 | France | 9/4 R |
| 974661 | 11/1948 | France | 9/4 R |

*Primary Examiner*—Edward R. Kazenske
*Assistant Examiner*—Winston H. Douglas
*Attorney, Agent, or Firm*—Scrivener, Parker, Scrivener and Clarke

[57] ABSTRACT

A substantially circular, round lifeboat provided with a flat bottom surface and upwardly curved sides, the interior of the boat being provided with a series of concentrically arranged seats for the passengers, mostly near the bottom of the boat to provide a low center of gravity, the boat having a fiber glass hull and a fiber glass covered styrofoam interior in order that it be strong and sturdy, while being relatively light in weight, with the capability of each boat being molded in two pieces (hull section and seat and rib section) and joined together, the upper perimeter of the boat having a plurality cf spaced-apart arms for supporting transparent plastic panels which extend upwardly and thus increase the free-board, the arms also providing support for a plurality of curved supporting ribs arranged in a dome-shaped fashion to support a suitable cloth material to form a complete cover for the open upper portion of the boat. With the arms stored in down position and the ribs stored in back of the upper seats, 8–10 or more lifeboats may be stacked in a convenient area of the vessel, like soup bowls and may be covered.

3 Claims, 6 Drawing Figures

CIRCULAR LIFEBOAT

SUMMARY OF THE INVENTION

The boat hull is substantially soup bowl shaped in general configuration provided with a flat bottom integrally joined to a rounded circular side wall. The interior seats are arranged in concentric rows and some may be provided with hinged portions to provide extra storage space for life saving equipment such as tools, radios, lights, batteries, emergency food rations, etc. In general however, the seats are provided with flotation material such as styrofoam built into the hull under the seats. The circular shape of the boats is such that a plurality of them may be stacked on the upper deck of a vessel to occupy less space than conventional lifeboats, and may be covered and protected from the weather when not in use. The boats are light in weight, may be molded, and may be readily loaded with passengers, and launched with a minimum of effort by using small crane or davits. The interior construction is strengthened by the use of a series of spaced apart reinforcing ribs formed on the inner wall. A special feature resides in the use of a plurality of rotatable arms which are normally rotated to a storage position inside the boat so lifeboats may be stacked, but which may be rotated to an upper position for supporting a plurality of transparent panels of plastic, such panels extending upwardly of the perimeter of the boat a substantial distance to effectively increase the free-board of the lifeboat. The arms are also constructed so as to support a covering construction so that when these parts are assembled, the lifeboat is substantially weather-proof, thus enhancing the safety and comfort of the passengers.

The principal object of the invention is thus to provide a circular lifeboat which may be readily stacked with other lifeboats similarly constructed and covered and which will be highly efficient and safe in operation as well as comfortable in use and economical to maintain.

BRIEF DESCRIPTION OF THE DRAWING

In the drawings wherein similar reference characters refer to similar parts throughout the several views.

DESCRIPTION OF THE INVENTION

Figure 1:
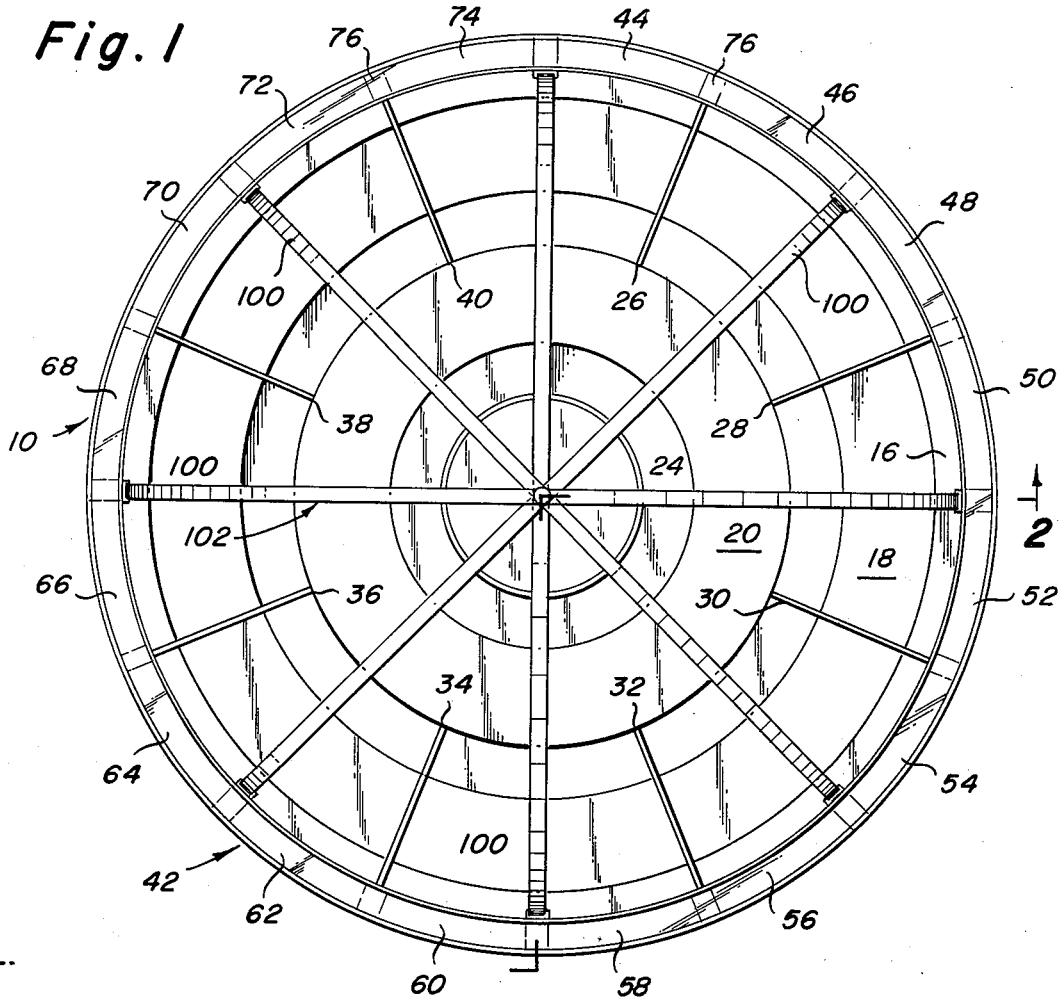
FIG. 1 is a top view of a circular lifeboat constructed in accordance with the present invention.
Figure 2:
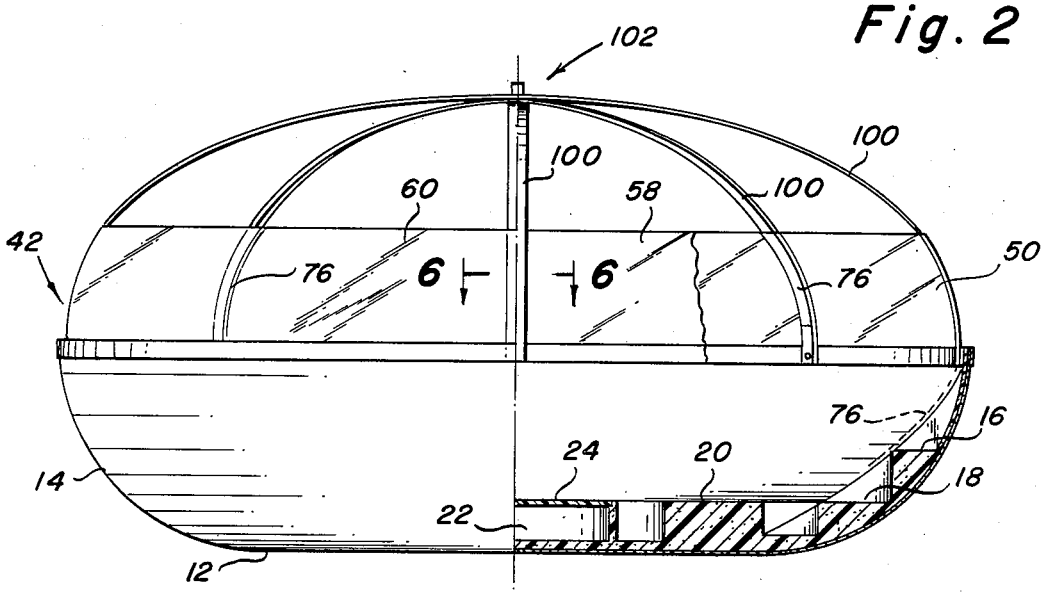
FIG. 2 is a side view partly in section and taken along line 2—2 of FIG. 1.

Referring more particularly to FIGS. 1 and 2, the present invention is illustrated therein as comprising a circular lifeboat 10 having a flat bottom 12 and a round or circular side or hull portion 14. The interior of the boat is provided with a series of concentrically arranged passenger seats, 16, 18 and 20 and a centrally disposed storage area 22 provided with a suitable cover 24 which may function as a passenger seat. The area 22 may be used for the storage of various articles and equipment which would be useful to the occupants of the boat such as navigational equipment, provisions, flares, lights and batteries, outboard motor, tools, fuel, radios, radar reflection panels, etc. The lifeboat may be constructed in any suitable manner such as molding the boat in two pieces (round bowl shaped hull and seat and rib section) and then fusing them together. Preferably the exterior hull portions 12 and 14 are formed from fiber glass and the interior has molded strengthening ribs and seat areas of plastic or fiberglass and the area under seats is filled with styrofoam, these materials giving great strength and stability as well as excellent flotation and insulation. As shown in FIGS. 1 and 2, a plurality of strengthening ribs 26, 28, 30, 32, 34, 36, 38 and 40 are formed on the inner side of the hull portion 14 and these materially increase the strength of the boat. At the inside perimeter of the hull at the top thereof, an aluminum band 41 is positioned and at the outer perimeter at the top, a rub rail is provided, see FIG. 3.

An important feature of the present invention resides in a novel construction for increasing the free-board of the lifeboat by providing a circular partition structure which may be quickly erected at the periphery of the hull. More particularly, and as shown in FIG. 1, such construction includes a continuous partition 42 which is comprised of a plurality of curved panel sections 44, 46, 48, 50, 52, 54, 56, 58, 60, 62, 64, 66, 68, 70, 72 and 74 and which when erected, substantially increases the free-board of the boat. Boats may be used with all panels stored, some stored or all in use position depending on safety and comfort conditions. When not in use the panel sections are stored within the boat adjacent to the top tier of seats directly below where they will be used. In the form of the invention illustrated, the lifeboat may be 25 feet in diameter with a normal height of 5-½ feet accommodating 125–150 people. The height of the partition structure may be 3 feet so that an appreciable increase in free-board is achieved by the use of this structure. Sixteen panel sections of clear plastic with small aluminum bar affixed to top and bottom for strengthening and foam rubber strips glued on edges and bottom for waterproofing are used in the embodiment shown.

Figure 3:
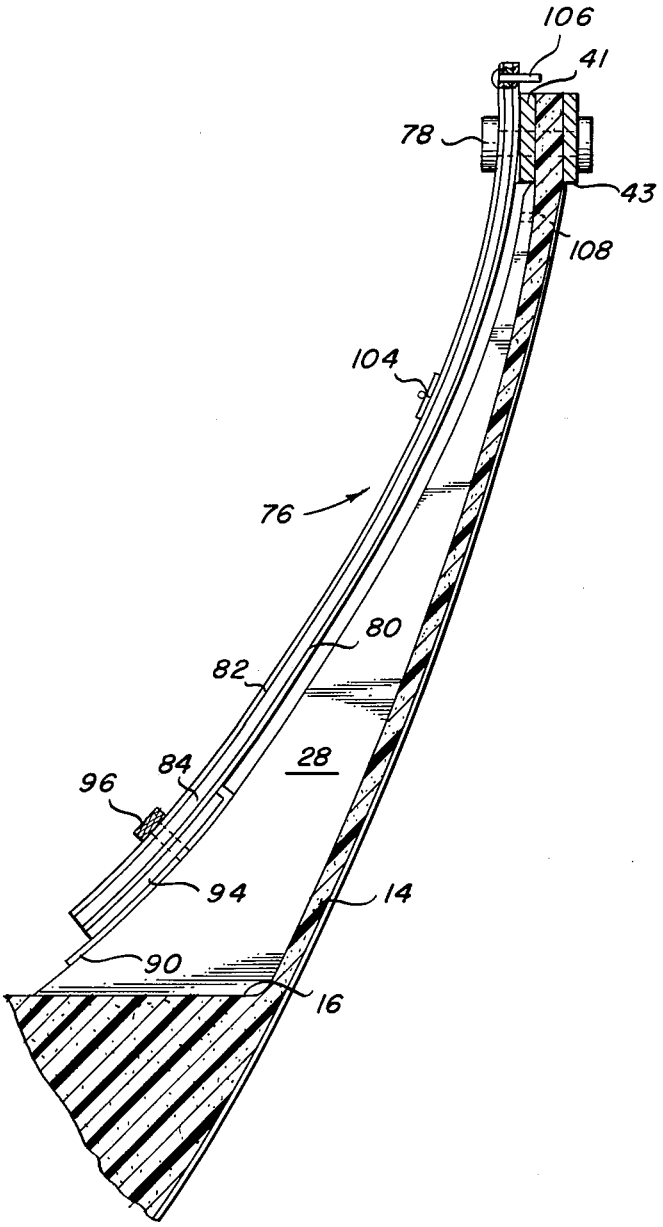
FIG. 3 is a partial view partly in section of a portion of the side hull of the lifeboat and showing the storage position of one of the panel-supporting arms.
Figure 4:
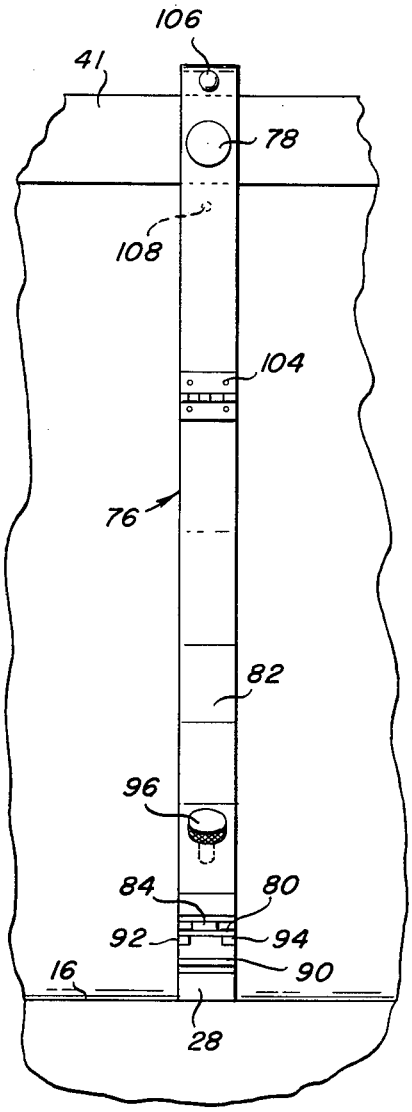
FIG. 4 is a front view of the panel-supporting arm shown in storage position.
Figure 6:
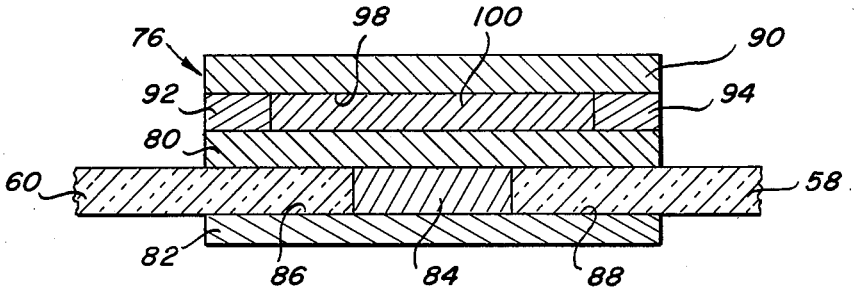
FIG. 6 is a sectional view taken along line 6—6 of FIG. 2 and shows the construction of one of the panel-supporting arms with a pair of panels in place and an end of one of the cover-supporting ribs also in place.

In order to support the panel sections 44, etc. in place, a plurality of rotating arms 76 of metal such as aluminum and which are similar in construction are pivotally connected at their upper ends to the inner perimeter of the hull by bolts 78 and are normally positioned within the boat and are curved to fit along the edge of a supporting rib 28, see FIG. 3. Referring more particularly to FIGS. 3 and 6, each rotating arm includes a main arm 80 and an inner arm 82, the latter two arms being spaced apart by a central spacer bar 84, these parts thus defining slots 86 and 88 extending the length of the rotatable arm 76 and positioned on opposite edges of the spacer bar 84. Adjacent the lower end of the rotatable arm 76 as seen in FIGS. 3 and 6, a short bar 90 and a pair of spacer bars 92, 94 are secured to the arms 80 and 82 by bolt 96 and provide a slot 98 between the edges of the spacer bars 92, 94 for the reception of an end of a rib 100 forming an element of a rib construction 102 for supporting a top cover for the boat. The construction 102 comprises a plurality of ribs 100 which are pivoted intermediate their ends, so that they may be arranged in a folded position for ready storage within the boat when not in use. As shown in FIG. 3, the inner arm 82 comprises two sections which are hingedly connected together at 104, this arrangement materially facilitating the installation of the closure panels 44 etc., as will appear hereinafter. It is only necessary that alternate arms be provided with hinged sections in order to efficiently install the panel sections, but all the arms may be provided with hinged sections if desired.

Figure 5:
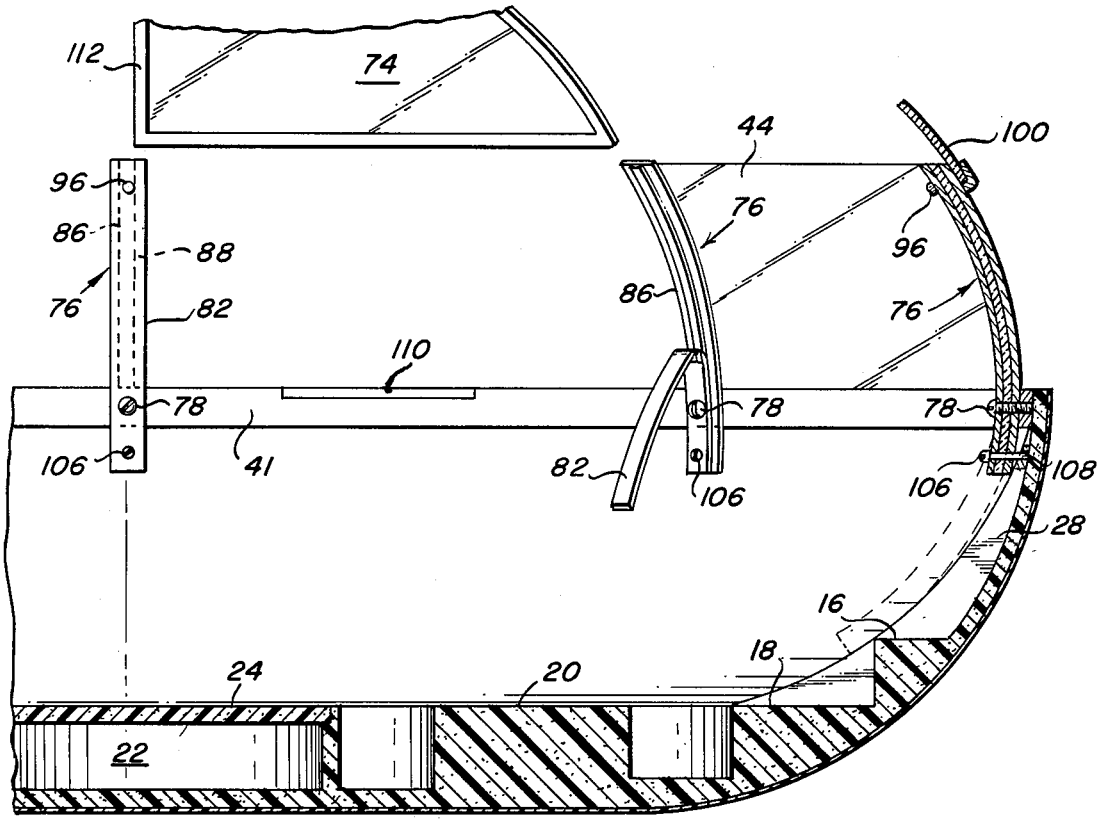
FIG. 5 is a view of a portion of the interior of the lifeboat, partly in section, and showing the manner of assemblying one of the closure panels.

When it is desired to erect the partition 42, the rotatable arms 76 are rotated to the upper position as shown in FIG. 5 and the bolt 96 is removed so that the upper portion of the inner arm 82 may be moved downwardly about its hinge 104 to expose the slot 86. The panel section 74 may then be fitted in the slots 88 and 86 of adjacent arms and pushed downwardly to a closed position at the band 41, following which the hinged portion of the arm 82 is moved upwardly and the bolt 96 is replaced. Successive panel sections are installed in a similar manner to complete the partition. However, if desired, some panels may be omitted, the use of the panels being solely dictated by the safety and comfort of the passengers from high seas, wind or rain. Preferably, the panel sections are made of a transparent plastic material and are concave in both vertical and horizontal directions to fit the curved shape of the rotating arms 76 and the shape of the top of the hull. This is well illustrated in FIG. 2.

After all of the rotatable arms 76 have been rotated upwardly and the panel sections installed, the rib construction 102 may be assembled in the slots 98 and a suitable fabric cover of nylon or the like fitted over and secured to the rib construction in any suitable manner.

Referring to FIG. 3, it will be noted that a pin 106 is positioned adjacent the upper end of the rotating arm 76. This pin is removed from the arm 76 when the latter is rotated upwardly and reinserted in the arm 76 to extend into an opening 108 in the rib 28 or the boat hull to hold the arm in an upright position while installing the panel sections.

In order to firmly support each panel section and seal it in position, a channel-shaped bar 110, FIG. 5, may be secured to the band 41 for receiving the lower edge of the panel section and the lower and side edges of each panel may be provided with a rubber sealing gasket 112.

From the foregoing, it will be readily seen that the present invention provides a novel lifeboat construction which has many advantages and desirable features. The rounded circular construction with the special rib and seat arrangement affords great strength and structural stability while facilitating ideal stacking capability to save space and to enable the boats to be completely covered and stored aboard ship when not in use.

Among other features, the top construction is unique in the arrangement of rotatable arms for not only supporting the partition panels but for also supporting a top covering for the boat.

Further features of novelty will readily appear to those skilled in the art and it is expressly understood that the invention is not limited to the form illustrated but may be embodied in other forms within the scope of the appended claims.

What is claimed is:

1. A circular lifeboat having a bowl shaped configuration including a flat bottom and a rounded circular hull, the interior of the lifeboat including a plurality of concentrically arranged seats, and a continuous partition positioned around the perimeter of the lifeboat and extending upwardly to provide an additional area of free-board, said partition including a plurality of plastic panels, each panel having its opposite edges supported by a pair of upwardly extending rotatable arms, each of said rotatable arms pivotally connected to the upper edge of the boat hull, and is movable from a normally stored position within the confines of the upper edge of the boat hull and to an upright active position wherein each arm is positioned vertically, each arm being provided with a pair of longitudinally extending slots positioned on opposite edges thereof for receiving edges of plastic panels, each of said arms is further provided with a slot for receiving an end of a top supporting rib when the arms occupy their vertical position, each panel being readily removable for storage within the boat and each arm being rotatable for storage within the boat.

2. A circular lifeboat as set forth in claim 1 which includes a plurality of spaced-apart, curved strengthening ribs formed on the inner portion of the boat hull, and the upwardly extending arms are curved to lie against the ribs when in stored position, each of the plastic panels being concave in both vertical and horizontal directions to fit the curved shape of the arms and the shape of the top portion of the hull.

3. A circular lifeboat as set forth in claim 1 wherein said rotatable arms are equally spaced-apart around the periphery of the lifeboat, and each rotatable arm includes an inner arm and an outer arm, the last two arms being spaced apart to define said longitudinally extending slots, said rotatable arms being movable to the upright active position, the inner arms of alternate rotatable arms being hinged to provide upper and lower sections, the upper section of each alternate arm being moved inwardly to expose a portion of said longitudinally extending slots and portions of the outer arm whereby the edges of a pair of adjacent plastic panels are positioned in said exposed portions of said slots to lie against said portions of the outer arm as the panels are moved downwardly in the slots of the rotatable arms on either side of said alternate rotatable arms.

* * * * *